United States Patent [19]

Bradshaw et al.

[11] 4,243,333

[45] Jan. 6, 1981

[54] PRINTING APPARATUS

[75] Inventors: Franklin C. Bradshaw, St Paul; Thomas P. Connoy, Lino Lakes; Dennis A. Deutsch, Stillwater, all of Minn.

[73] Assignee: Kroy Industries, Inc., Stillwater, Minn.

[21] Appl. No.: 922,566

[22] Filed: Jul. 7, 1978

[51] Int. Cl.[2] ..... B41J 1/28; B41J 3/20; B41J 3/30; B41J 9/26

[52] U.S. Cl. ..... 400/158; 400/48; 400/134; 400/208; 400/613

[58] Field of Search ..... 101/288; 400/48, 158, 400/134, 134.6, 194–196.1, 207–208.1, 236, 613, 615.2, 654

[56] References Cited

U.S. PATENT DOCUMENTS

| | | | |
|---|---|---|---|
| 3,834,507 | 9/1974 | Bradshaw | 400/134.6 |
| 3,880,270 | 4/1975 | Travis et al. | 400/134 |
| 4,015,700 | 4/1977 | Paque | 400/617 |

*Primary Examiner*—Paul T. Sewell
*Attorney, Agent, or Firm*—Dorsey, Windhorst, Hannaford, Whitney & Halladay

[57] ABSTRACT

A dry lettering printing apparatus comprising a printing station, a means for providing a color carrying ribbon and image carrying tape at the printing station, a means for providing a raised character in printing alignment at the printing station, an improved force generating means for exerting a printing force at the printing station and an improved means for advancing the tape and ribbon into printing alignment at the printing station. The improved advancement means includes a cartridge carrier movable reciprocally toward and away from the printing station for advancing the tape into printing alignment.

29 Claims, 12 Drawing Figures

PRINTING APPARATUS

BACKGROUND OF THE INVENTION

The present invention relates generally to an improved printing apparatus or composing system, and more particularly, to an improved printing apparatus or composing system of the type involving the use of a pressure process to transfer dry carbon impressions onto an image carrying tape. Such apparatus or system includes a printing station, a printing force generating means, a tape and associated carbon ribbon, a type disc or font element with a raised character positionable in printing alignment with the printing station and means for advancing the tape and ribbon with respect to the printing station. The apparatus of the present invention has particular application in the printing of relatively large characters for use in preparing lettering for engineering drawings, flip charts, overhead transparencies, posters, newspaper headlines, etc. These characters are generally much larger than most typewriters or other conventional means can generate.

In the prior art, several means have been used to create such letters; these include stencils, press-on letters, photographic type setters, thermal type setters and dry lettering printing processes. The present invention relates to improvements in a dry lettering printing process. In such a process, a high pressure is utilized to transfer dry carbon or other ink or color material from a ribbon onto an image carrying tape. A typical process may require pressures as high as 5000–6000 p.s.i. or higher. A type disc or font element having raised portions corresponding to the particular image desired to be printed is commonly used in such a process. Typical prior art machines and apparatus utilizing dry lettering processes are shown and described in U.S. Pat. Nos. 3,834,507, 3,912,064 and 4,015,700 and pending application Ser. No. 726,106, filed Sept. 24, 1976. While most of these prior art machines have been capable of generating generally high quality printing and lettering results, there is a need for a printing apparatus which is simpler in construction (and thus less expensive), requires less maintenance, but which still provides high quality printing and lettering results. Each of the above art patents discloses a printing apparatus having, among other things, a means for generating a printing pressure, and a means for advancing the tape and ribbon through the equipment. The present invention relates to an improved apparatus incorporating an improved means for generating the necessary printing pressure and an improved means for advancing the tape and ribbon with respect to the printing station.

SUMMARY OF THE INVENTION

The present invention relates to an improved printing apparatus or composing system of the type utilizing a pressure process to transfer dry carbon impressions to an image carrying tape or other medium and includes a printing station, a type disc or font element having a plurality of raised characters thereon, an improved means for generating a printing force and an improved means for advancing and supplying a tape and ribbon to the printing station. More particularly, the improved means for generating the printing force includes a linkage which can be actuated either manually or by machine. The linkage includes a toggle mechanism in combination with an elongated print bar having a printing pad thereon. With this particular linkage, a mechanical advantage of at least 150-1 can be generated. Accordingly, with a relatively small exertion of force on the printing button or on the linkage force arm, a sufficient printing force can be generated. In the apparatus of the preferred embodiment, this may be 1500 pounds or greater.

The improved means for advancing the ribbon and tape includes a tape and ribbon cartridge holder which is movable reciprocally toward and away from the printing station. This means includes an improved linkage for transferring a force between the force generating linkage and the cartridge holder to cause such reciprocating movement of the cartridge holder. The cartridge holder contains a tape-ribbon cartridge from which tape and ribbon is supplied to the printing station in printing alignment.

The apparatus of the present also includes a means for adjusting the permitted movement of the cartridge carrier to thereby adjust advancement of the tape and ribbon, a means for properly aligning the font in printing registration with the printing station and improved means for stripping the ribbon from the font after printing and guiding and rewinding the used ribbon.

Accordingly, a primary object of the present invention is to provide an improved lettering apparatus or composing system of the type utilizing a dry lettering process with improved means for generating the printing pressure and improved means for advancing the tape and ribbon.

Another object of the present invention is to provide an improved lettering apparatus or composing system having an improved force generating means comprising a toggle linkage and an elongated print bar.

A further object of the present invention is to provide an improved lettering apparatus or composing system having an improved means for advancing the tape and ribbon past relative to the printing station, which means includes a cartridge holder movable in reciprocating relationship relative to the printing station.

Another object of the present invention is to provide an improved lettering apparatus and composing system having an improved ribbon stripping means and an improved ribbon rewind mechanism.

These and other objects of the present invention will become apparent with reference to the drawings, the description of the preferred embodiment and the appended claims.

DESCRIPTION OF THE PREFERRED EMBODIMENT

Figure 1:
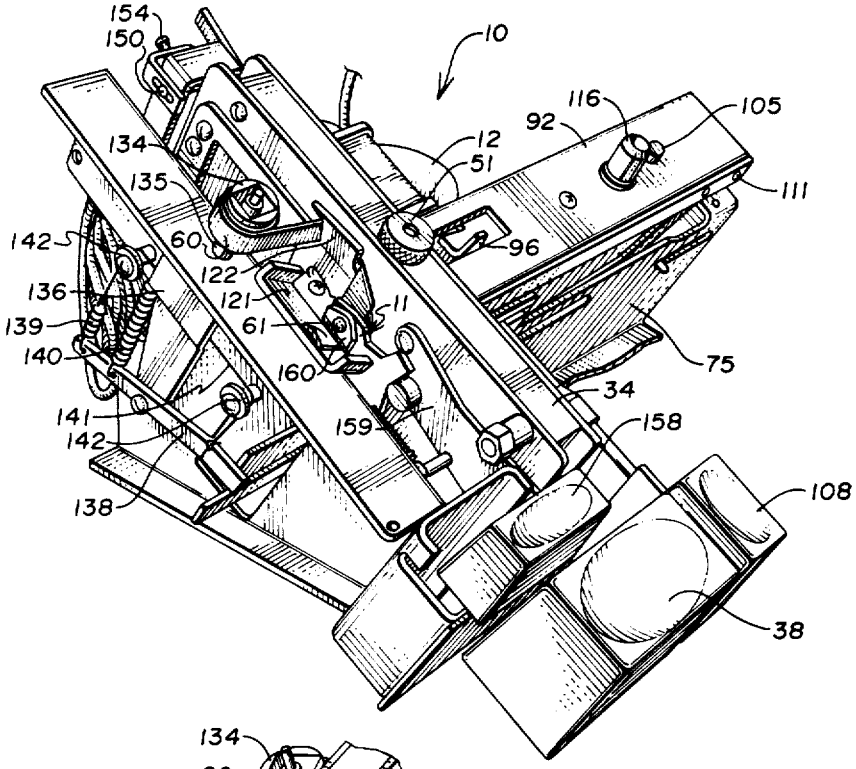
FIG. 1 is a pictorial view of the printing apparatus of the present invention as viewed from an elevated left front corner.
Figure 2:
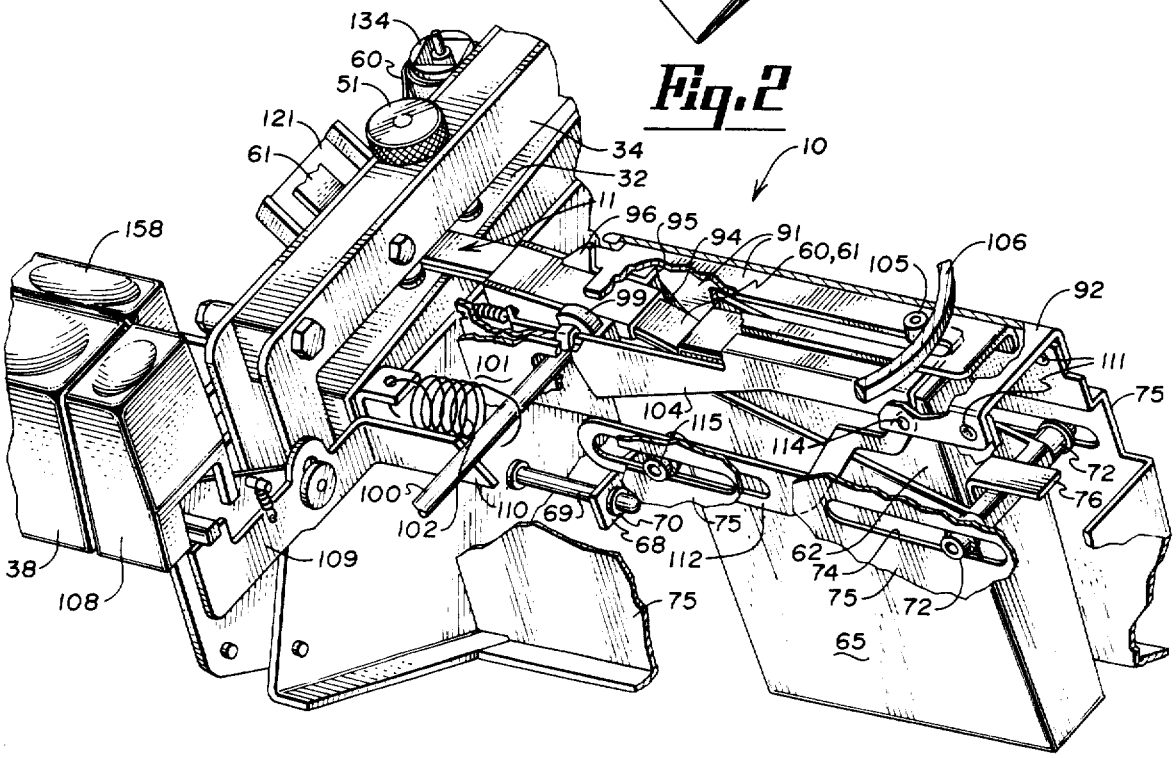
FIG. 2 is a pictorial view of the printing apparatus of the present invention as viewed from an elevated right front corner.

Reference is first made to FIGS. 1 and 2 which show pictorial views of the lettering or printing apparatus of the present invention. In general, the printing apparatus 10 includes a printing station, a means for exerting a printing pressure or force at the printing station and an improved means for advancing the tape and ribbon with respect to the printing station.

Figure 3A:
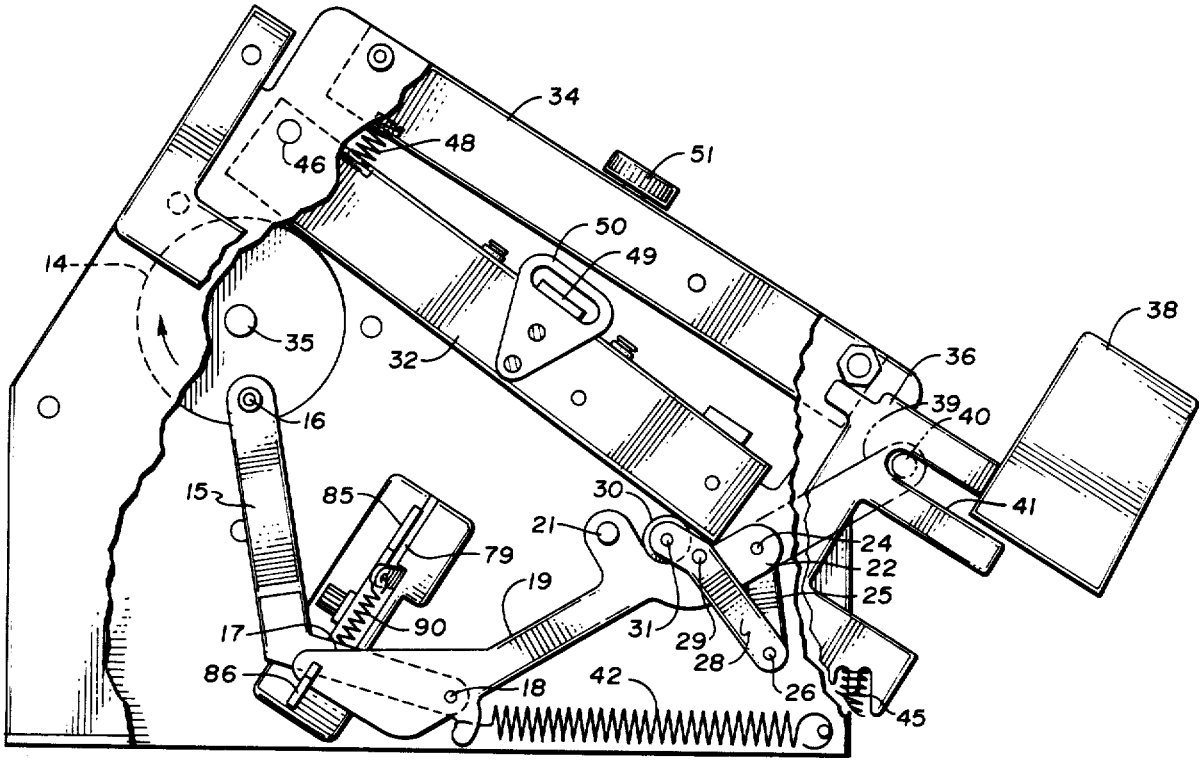
FIG. 3*a* is a plan view of one side of the printing apparatus of the present invention showing the force generating means prior to commencement of a printing cycle.
Figure 3B:
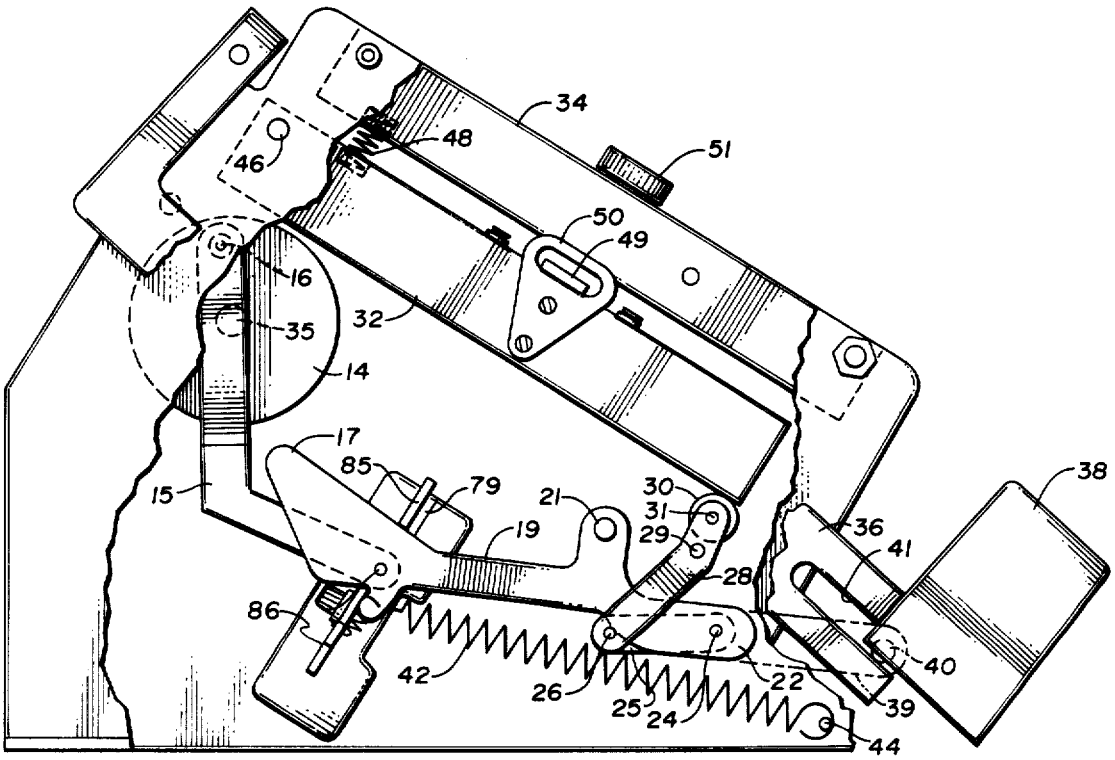
FIG. 3*b* shows a plan view of the printing apparatus of the present invention showing the force generating means in the middle of a printing cycle at the point where the printing force being generated is at its maximum.

In FIGS. 3*a* and 3*b*, the means for generating the printing pressure is more specifically illustrated. It should be noted that the printing force or pressure in the present system can be generated either manually or with assistance from an electric motor or other power generating means. The preferred embodiment of the present invention shows the printing force generated with the assistance of an electric motor 12 (partially illustrated in FIG. 1) which includes a rotatable shaft 35 and a circular drive plate 14 connected therewith. A motion transfer link 15 has one end connected at the pivot 16 to the drive plate 14 and its other end pivotally connected at the point 18 to the operating drive link 19. The drive link 19 in turn is pivotally connected between its ends to a portion of the apparatus frame at the pivot point 21. One end 22 of the drive link 19 is pivotally connected at the pivot 24 to a force transfer link 25 which in turn is pivotally connected at the pivot 26 to one end of a toggle link 28. The toggle link 28 is pivotally connected with the frame of the printing apparatus at the point 29. The other end of the link 28 includes a short arm portion and a pivot point 31 to which a roller member 30 is rotatably mounted.

As illustrated, the roller member 30 is adapted for rolling engagement with the lower surface of a lower, elongated print bar 32 for upward movement of the same toward an upper, elongated print bar 34. Upon actuation of the motor, the drive plate 14 is rotated in a clockwise direction as illustrated. This causes the pivot 16 and thus the connecting link 15 to move upwardly, resulting in upward movement of the pivot 18 and corresponding movement of the drive link 19 in a clockwise direction about its pivot point 21. This results in corresponding pivotal movement of the link 28 about its pivot 29 via the transfer link 25. Such movement causes the roller 30 to move upwardly toward the position shown in FIG. 3*b* and corresponding movement of the lower print bar 32 towards the upper print bar 34. Upon completion of this upward movement, the link 19 pivots in a counterclockwise direction and the print bar 32 is lowered.

It should be noted that as the toggle lever 28 pivots clockwise and the print bar 32 moves upwardly, the roller 30 approaches a point at which a line extending through the roller axis 31 and the toggle pivot 29 is perpendicular to the lower print bar 32. Just prior to this perpendicular position, further rotational movement of the lever 28 results in a tremendous mechanical advantage at the point where the roller 30 contacts the print bar 32 and thus generation of a large print force.

In the preferred embodiment, the motor 12 (FIG. 1) is actuated by a microswitch (not shown) and an appropriate linkage, a portion of which is illustrated by reference numeral 36 connected with the print button 38. Upon manual depression of the print button 38, the linkage 36 activates a microswitch which in turn activates the motor to commence the printing cycle. It should be noted that the connecting linkage 36 may include an associated spring member 45 between a portion of the linkage 36 and the frame of the apparatus to return the print button 38 to its up position following a printing cycle.

FIGS. 3*a* and 3*b* also illustrate a manual version of the printing force generating means. Specifically, the manual version of such apparatus includes an extension of the drive link 19 which is illustrated by the broken line 39. This extended link includes a pin or other appropriate means 40 adapted to ride in a slot 41 between a bifurcated portion of the connecting linkage 36. In the manual version, the motor 12, associated drive plate 14 and the connecting link 15 are eliminated. The manual version also includes a return extension spring 42 extending between the point 44 on the apparatus frame and a portion of the drive link 19 which functions to return the same to its lower rest position following a printing cycle. The motor version does not need such a spring member 42 since the connecting or drive link 19 is returned to its position by rotation of the drive plate 14 and corresponding downward movement of the connecting link 15. The operation of the manual version is similar to the motor version. Specifially, upon downward movement of the printing button 38, the drive link 19 is pivoted in a clockwise direction about the pivot 21 resulting in clockwise movement of the link 28 about the point 29 and corresponding upward movement of the lower print bar 32.

The means by which the printing pressure is actually applied comprises a pair of elongaged print bars 32 and 34. The upper print bar 34 is securely and rigidly connected with the apparatus frame by a plurality of bolts or other connecting means. The lower print bar 32 is pivotally mounted with respect to the apparatus frame about the pivot 46. A spring member 48 is disposed between the print bars 32 and 34 to separate them following completion of the printing step. As illustrated in FIGS. 3*a* and 3*b*, the lower print bar 32 includes a print pad 49 which in the preferred embodiment is constructed of a urethane material. Both of the elongated print bars 32 and 34, in the preferred embodiment, are constructed of solid steel, or other appropriate material to prevent deflection thereof during the printing cycle. The urethane print pad 49 is positioned approximately in the center of the elongated print bar 32; whereas, the force from the roller 30 is applied near the end of the bar 32 opposite the pivot 46. This relationship provides for an additional 2 to 1 mechanical advantage between the force applied by the roller and the force applied at the point of the pad 49.

Figure 4:
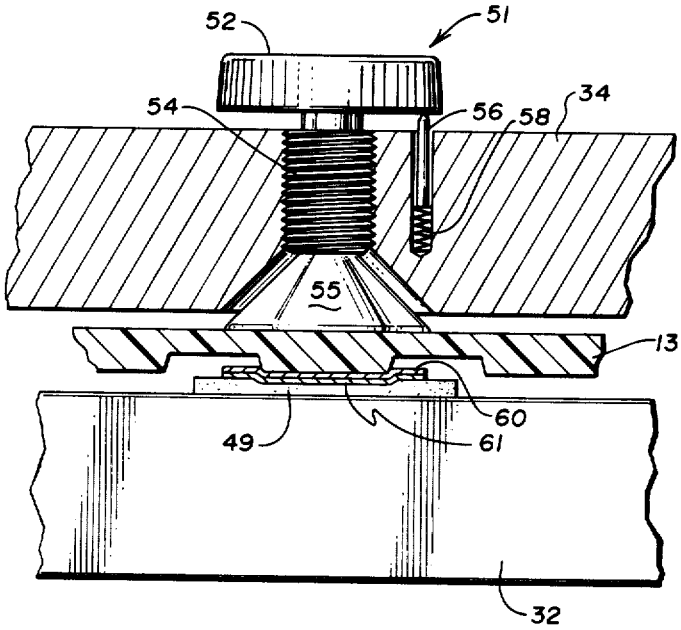
FIG. 4 is a sectional view showing the printing force adjustment means.

As illustrated particularly in FIG. 4, the upper print bar 34 includes a printing pressure adjustment means 51. This means includes a manually rotatable pressure control knob 52, a pressure foot member 55 and a threaded shaft 54 integrally formed with and extending between the pressure control knob 52 and the pressure foot 55. The threaded shaft 54 is threadedly received by the bar 34. The pressure adjustment means 51 is adapted for upward and downward movement in response to rotation of the control knob 52 to vary the printing pressure generated by the respective printing bars 32 and 34 and the pressure generation linkage shown in FIGS. 3*a* and 3*b*. The printing pressure is developed as a result of upward movement of the print bar 32 and thus the printing pad 49 toward the pressure foot 55. Raised characters of a type disk or font element 13 together with a color carrier or ribbon 60 and an image carrier or tape 61 are disposed between the foot 55 and pad 49. As the pressure foot 55 is lowered, the printing pressure is increased; as it is raised, the printing pressure is decreased. A detent device in the form of the pin 56 and spring 58 is contained within the upper print bar 34 to act against the lower surface of the pressure control knob 52. The lower surface of the knob 52 includes a plurality of small detents or recesses about its periphery into which the pin 56 is biased by the spring 58. This precludes inadvertent rotation of the control knob 52 and allows the operator to more accurately adjust the printing pressure.

Figure 5:
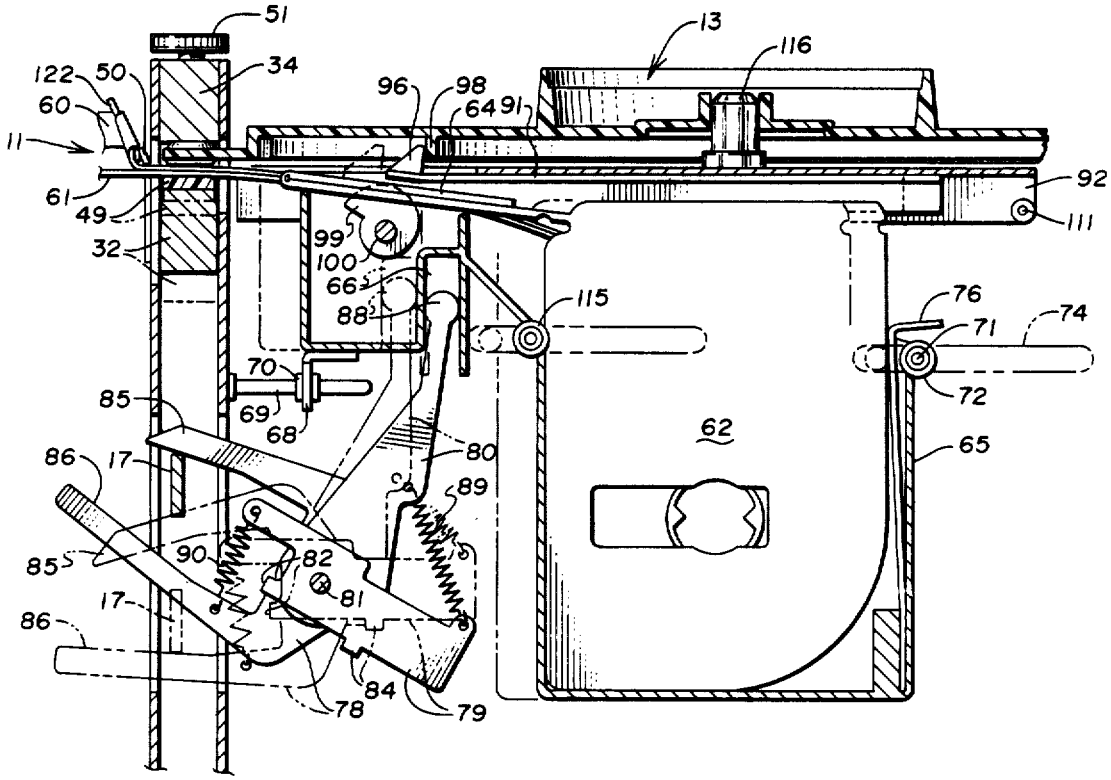
FIG. 5 is a view, partially in section, showing the cartridge carrying means and the linkage for causing reciprocal movement of the cartridge carrier.
Figure 8:
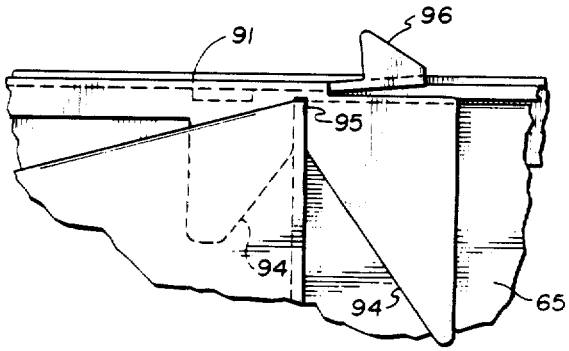
FIG. 8 is an elevated view of the lettering spacing slide and its relationship to the cartridge carrier.

The mechanism for advancing the tape to the printing station can be understood best with reference to FIGS. 5 and 8. With reference first to FIG. 5, the printing ribbon and tape, 60 and 61 respectively, are supplied to the printing station area 11 from a tape-ribbon cartridge 62 having an elongated tape guide portion 64. This tape-ribbon cartridge 62 is mounted within a cartridge carrier or holder 65. The cartridge carrier 65 includes a generally rectangular shaped well portion for receiving the tape-ribbon supply cartridge 62 and a recessed area 66 adapted to receive one end of a drive arm as will be described below. The cartridge carrier 65 is mounted with respect to the apparatus frame at three points. The first point is a sliding connection existing between the mounting bracket 68 and the support post 69. The mounting bracket 68 is securely joined with the forward portion of the cartridge carrier and includes a generally cylindrically shaped collar portion 70 adapted for sliding engagement with the support post 69. The support post 69 is securely joined with a portion of the apparatus frame and accordingly serves as a support for the cartridge carrier 65 during its reciprocal movement toward and away from the printing station 11. The carrier 65 is further supported by the pin 71 and the associated pair of mounting bearings 72 adapted for sliding or rolling movement within an elongated slot 74 formed in the cartridge carrier support housing 75 formed on each side of the carrier 65. The pin 71 extends through a rearward portion of the housing 75 with the bearing member 72 disposed on each end thereof for sliding movement within the slots 74. This three point support of the carrier 65 enables the carrier 65, and thus the cartridge 62 contained therein, to move reciprocally toward and away from the printing station 11. Such movement also results in corresponding movement of the tape 61 and ribbon 60 relative to the printing station 11.

As will be discussed in more detail below, forward movement (toward the left as viewed in FIG. 5) of the cartridge carrier 65 results in similar forward movement of the cartridge 62 and thus the tape 61 and ribbon 60. However, because the ribbon 60 and tape 61 are clamped or prevented from moving during rearward movement of the carrier 65 and cartridge 62, ribbon 60 and tape 61 are fed from the cartridge 62 during such rearward movement. During forward movement of the cartridge 62, the clamping means is released and the tape 61 and ribbon 62 are allowed to advance relative to the printing station 11. The cartridge carrier 65 includes a leaf spring member 76 normally biased in the forward direction for tightly securing the cartridge 62 within the carrier 65.

The particular linkage by which the cartridge carrier 65 is reciprocally moved toward and away from the printing station is illustrated best in FIG. 5. Such mechanism includes a carrier drive yoke 78 with a pair of yoke arms 85 and 86, a transfer plate or member 79 and an elongated drive arm 80. Each of these elements 78, 79 and 80 are all rotatably mounted with respect to the pivot 81. The transfer plate 79 includes a first tab portion 82 extending at right angles to the main surface of the plate 79 for engaging a portion of the drive yoke during pivotal movement of the drive yoke 78 in a clockwise direction thereof. The transfer plate 79 also includes a second tab portion 84, positioned generally at right angles with respect to the surface of the plate 79 for engaging a portion of the drive arm 80.

One end of the transfer plate 79 is connected with a portion of the yoke arm 86 by the override extension spring 90. The effect of this spring 90 is to urge the transfer plate 79 and the yoke 78 in rotational movement toward each other so that the tab portion 82 engages a portion of the yoke 78 and prevents further relative rotational movement. This relative position between the plate 79 and the yoke 78 is illustrated by the solid lines in FIG. 5. Similarly, the other end of the transfer plate 79 is connected with a portion of the drive arm 80 by the override extension spring 89 which urges the drive arm 80 and plate 79 in rotational movement toward each other so that the tab portion 84 engages a portion of the drive arm 80 and prevents further such relative rotational movement. The relative position between the elements 79 and 80 when the tab 84 is so engaged is illustrated by the broken lines in FIG. 5. Both of the springs 89 and 90 are considered override springs which permit limited relative movement of certain of the linkage elements 78, 79 and 80 with respect to others during a printing cycle. The drive arm 80 includes an upper or drive end 88 which is disposed within the recessed portion 66 of the cartridge carrier 65. The relationship between the end 88 and the recessed portion 66 is such that movement of the end 88 results in corresponding movement of the cartridge carrier 65. Such movement is illustrated in FIG. 5 by comparing the solid line position of the arm and cartridge with the broken line position.

The entire linkage illustrated in FIG. 5, and in particular elements 78, 79 and 80, is driven by one end 17 of the operating drive link 19 illustrated in FIGS. 3*a*, 3*b* and 5. Movement of the drive link 19 about its pivot 21 results in generally up and down reciprocal movement of the end 17. At various times during such movement, the end 17 engages portions of the arms 85 and 86 of the yoke member 78 to pivot the same either clockwise or counterclockwise as viewed in FIG. 5. Prior to commencement of the printing cycle, the relative positions of the drive link 19 and yoke arms 85 and 86 are illustrated in FIG. 3*a* and in the broken lines in FIG. 5. Upon commencement of the printing cycle, the end 17 moves upwardly about the pivot 21 (FIGS. 3*a* and 3*b*) and at a given point engages the lower surface of the upper yoke arm 85. Further upward movement of the drive link end 17 causes upward movement of the arm 85 and clockwise rotational movement of the yoke member 78 as illustrated in FIG. 5. During such clockwise movement of the yoke 78, the force transfer plate 79 is also moved in a clockwise direction as a result of engagement between the yoke 78 and the tab portion 82. Such clockwise rotational movement of the transfer plate 79 results in clockwise movement of the drive arm 80 as a result of a extension spring 89. In this respect, it should be noted that the spring 89 is sufficient, during this portion of the printing cycle, to retain the drive arm 80 in engagement with the tab member 84. Clockwise movement of the drive arm 80 results in rearward movement of the cartridge carrier 65 away from the printing station as a result of engagement between the drive arm end 88 and the sides of the recessed portion 66.

As will be described below, the advancement of the tape and ribbon 61 and 60 is directly proportional to the amount of rearward movement of the cartridge carrier 65 during the printing cycle. Means are provided in association with the carrier 65 to limit said rearward movement depending upon the particular character printed and the spacing desired. When such rearward movement is halted, the yoke member 78 and transfer plate 79 continue to rotate in a clockwise direction for a short distance. This additional movement is possible because of the spring member 89 which allows such override movement. During this additional movement, the tab portion 84 moves away from its engaged portion of the drive arm 80 and the spring member 89 extends.

The first half of the printing cycle is completed when the end 17 of the drive link 19 reaches its highest point. This position is illustrated in FIG. 3*b* and the solid line position of FIG. 5. During the second half of the printing cycle, the drive link end 17 begins to move downwardly toward the position illustrated in FIG. 3*a* and the broken line position of FIG. 5. During the initial portion of such downward movement, both the yoke 78 and transfer plate 79 are moved in a counterclockwise direction by the spring 89 until such time as the tab portion 84 engages the drive arm 80. At this point, the members 78, 79 and 80 remain stationary until the end 17 moves downwardly enough to engage the upper surface of the lower yoke arm 86. When this occurs, further downward movement of the end 17 results in movement of the yoke 78 in a counterclockwise direction. This counterclockwise movement is imparted to the transfer plate 79 via the spring member 90 which in turn is imparted to the drive arm 80 by the tab member 84. Such counterclockwise movement of the drive arm 80 causes forward movement of the cartridge carrier 65 and thus the tape-ribbon cartridge 62 toward the printing station 11.

As the end 17 approaches its lower position, the forward movement of the cartridge carrier 65 will be stopped, again for the purpose of providing desired spacing between characters, etc. When movement of the carrier 65 stops, movement of the drive arm 80 and transfer plate 79 also stops. Movement of the yoke member 78, however, will continue for a limited distance against the force of the spring member 90. Thus, during the final downward movement of the end 17, the yoke member 78 actually separates slightly from the tab member 82 resulting in extension of the spring 90. Therefore, as described and illustrated, the mechanism for moving the cartridge carrier 65 in reciprocal movement includes an override feature in the form of the springs 89 and 90 in both directions. In other words, both the rearward movment of the carrier 65 away from the printing station 11 and the forward movement of the carrier 65 toward printing station 11 can be limited and adjusted without affecting the basic operation of the force transfer linkage.

Associated with the cartridge carrier 65 is a means for limiting rearward movement of the carrier 65 away from the printing station 11 and a means for limiting forward movement of the cartridge 65 toward the printing station 11. The means for limiting the rearward movement of such cartridge is illustrated best in FIGS. 2, 5 and 8. In particular, this means includes a letter spacing slide member 91 which is mounted in sliding relationship with respect to the cartridge housing cover 92. Accordingly, the letter spacing slide 91 is capable of reciprocal movement toward and away from the printing station 11 relative to the cover 92. This mounting can be accomplished in any appropriate way such as mounting the slide 91 with respect to elongated slots in the cover 92 as in the preferred embodiments. The slide 91 is adapted for movement with the cartridge carrier 65. As illustrated in FIG. 8, the forward end of the slide member 91 includes a pair of inwardly disposed beveled surfaces which extend toward a notched portion 95. When the cartridge cover 92 and thus the slide 91 is in its operating position, the notch 95 engages a portion of the cartridge carrier 65 so that the carrier 65 and the slide 91 move together. The beveled surfaces 94 serve to properly seat the engaging portion of the carrier 65 in the notch 95 in the event the two are out of alignment when the cartridge cover 92 is closed. The slide 91 also includes a forwardly positioned tab or stop member 96 extending vertically upwardly from the main portion of the slide 91 and extending upwardly through an opening in the top portion of the cover 92. As shown in FIG. 5, a portion of the tab or stop member 96 extends above the cover 92 and is adapted for engagement with a letter spacing cam ring on the type disk or font 13. This spacing ring serves to limit the rearward movement of the stop member 96 and thus the cartridge carrier 65 and the cartridge 62 during a printing cycle.

With reference to FIG. 2, the means for controlling the forward movement of the cartridge carrier 65 includes the cam member 99 and the cam shaft 100. The shaft 100 is appropriately mounted with respect to the apparatus frame at one end and is adjustably mounted with respect to such frame near the other end by the mounting bracket 101. The cam member 99 is adapted for engagement with a forward surface of the cartridge carrier 65. Accordingly, upon engagement between the cam member 99 and such forward surface, further forward movement of the carrier 65 is prohibited. As illustrated best in FIG. 5, rotation of the shaft 100 causes corresponding rotation of the cam member 99 and thus varies the position of the surface engaging the carrier 65. Therefore, by appropriate rotation of the shaft 100, the permissible forward movement of the carrier 65 during the printing cycle can be controlled. In the preferred embodiment, an appropriate knob or dial is connected with the end of the shaft 100 (not shown) for convenient adjusting of the position of the cam 99. As will be described below, the permissible forward movement of the carrier 65 in combination with the permissible rearward movement determines the amount of tape and ribbon to be advanced toward the printing station 11 during a printing cycle. The shaft 100 is retained against the mounting bracket 101 by the spring member 102.

A short space means is also associated with the cartridge carrying assembly. Specifically, as illustrated in FIG. 2, the short space means includes a short space slide member 104 mounted in sliding relationship relative to the cartridge housing cover 92. The slide 104 includes a forwardly disposed surface adapted for engagement with the shaft 100. Rearward movement of the shaft 100 causes similar rearward movement of the slide 104. The slide member 104 also includes a short space stop member 105 extending upwardly from a portion of the slide through an opening in the cover 92 and above the cover 92. The short space stop 105 is adapted for engagement with a short space ring 106 integrally formed with the underside of the type disk or font 13.

Associated with this short space feature is a short space actuation means comprising the short space button 108 and the short space link 109. As illustrated in FIG. 2, the short space link 109 is pivotally connected with a portion of the apparatus frame and includes an "L" shaped end with a beveled surface 110 adapted for engagement with the shaft 100. Upon downward movement of the button 108, the link 109 pivots about its pivot point and causes the beveled surface to move against the shaft 100 resulting in corresponding rearward movement of the shaft 100 and similar rearward movement of the short space slide 104. This movement has the effect of rearwardly displacing the entire cartridge carrier 65 and cartridge 62 prior to actual commencement of the printing cycle so as to shorten the space between the character peviously printed and the character about to be printed. During this rearward movement of the cartridge and cartridge carrier, the tape and ribbon 61 and 60 are freely movable past the printing station 11.

With reference to FIGS. 2 and 5, it can be seen that the cartridge cover 92 is pivotally mounted with respect to the cartridge carrier housing 75. This connection is via the pair of mounting pins 111. One end of a carrier pull link 112 is connected with the cover 92 at the point 114 with the other end being adapted for association with a portion of the carrier 65. The link 112 includes an elongated slot adapted for limited sliding movement relative to the bearing member 115 on the carrier 65. When the cover 92 is opened and therefore pivoted about the connection pins 111, the link 112 moves relative to the bearing 115 for a limited distance until the end of the slot is reached, at which time further opening of the cover 92 causes the entire cartridge carrier 65 and cartridge 62 to move rearwardly away from the printing station. As the cover 92 is closed, the cartridge carrier 65 moves forwardly as a result of the spring member 90 shown in FIG. 5. Final alignment of the cartridge carrier 65 is achieved when the notch 95 (FIG. 8) of the letter spacing slide 91 is seated with respect to the carrier 65. A type disk or font mounting post 116 is disposed on top of the cover 92 for mounting the font element 13 as illustrated in FIG. 5.

Figure 9:
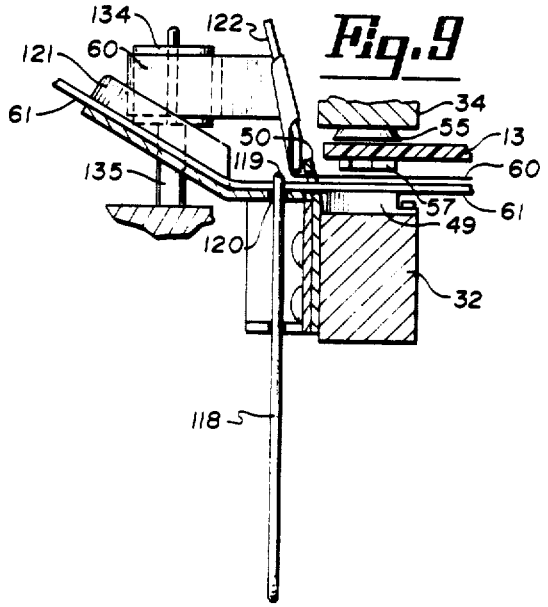
FIG. 9 is a side, elevated view, partially in section, showing the printing station and its related structure.

Reference is next made to FIGS. 6, 9, 10 and 11 which illustrated details of the actual printing or lettering operation. In general, as shown in FIG. 9, during a printing cycle, the lower print bar 32 and thus the printing pad 49 moves upwardly toward the upper print bar 34. During such upward movement, it carries the image carrying member or tape 61 and the color carrying member or ribbon 60 upwardly into engagement with the lower surface of the raised character 57 located on the outer periphery of the type disk or font 13. Further upward movement of the print bar 32 results in increased pressure being generated between these members resulting in a transfer of ink or carbon from the ribbon 60 to the tape 61 in the shape of the raised character 57. Associated with printing step is a means for stripping or releasing the ribbon 60 from the surface of the raised character 57, a means for clamping the tape 61 in a fixed position during a substantial portion of the printing cycle and a means for guiding the tape 61 past the printing station.

Figure 10:
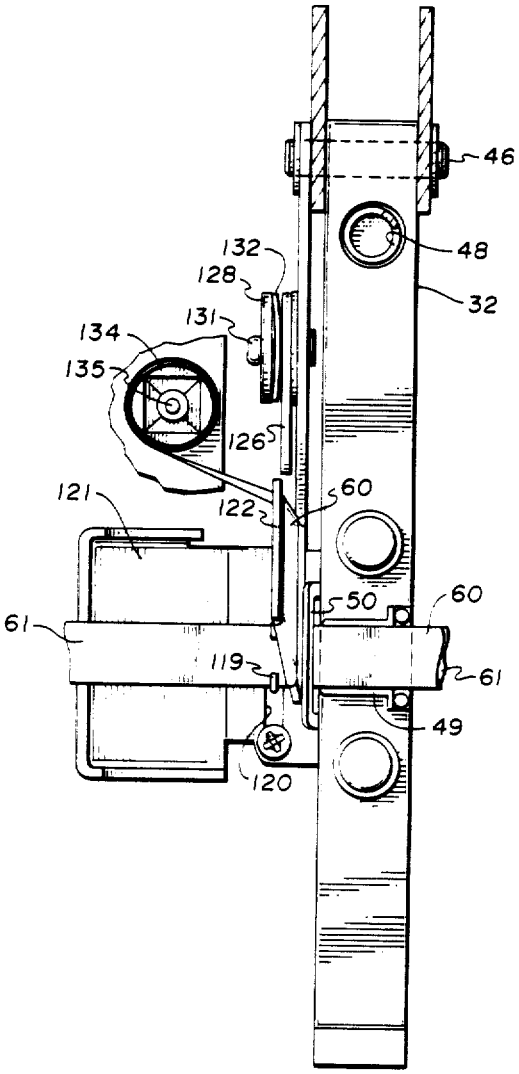
FIG. 10 is a plan view, partially in section, showing the printing station and its related structure.

As shown best in FIGS. 3, 9 and 10, the means for releasing or stripping the ribbon 60 from the raised characters 57 includes a ribbon stripping member 50 joined with and movable with the lower print bar 32. As shown best in FIG. 3, the ribbon stripper 50 includes an open portion above the print head 49 to permit the tape and ribbon 61 and 60 to pass therethrough and a stripping bar spaced slightly above the print head 49. Upon upward movement of the lower print bar 32 during the printing cycle, the ribbon stripper 50 serves no purpose; however, as the print bar begins its downward movement, the stripper 50 engages the upper surface of the ribbon 60 and strips or pulls it vertically downwardly away from the raised characters 57. The inventors have found that this particular movement of the ribbon away from the surface of the characters 57, in a generally perpendicular direction, is important in producing a high quality printing. If the stripper 50 were not used, the ribbon 60 would have more of a tendency to pull away from the characters 57 in a lateral direction resulting in a scraping of the ribbon surface and a generally inferior printing or lettering results.

Figure 11:
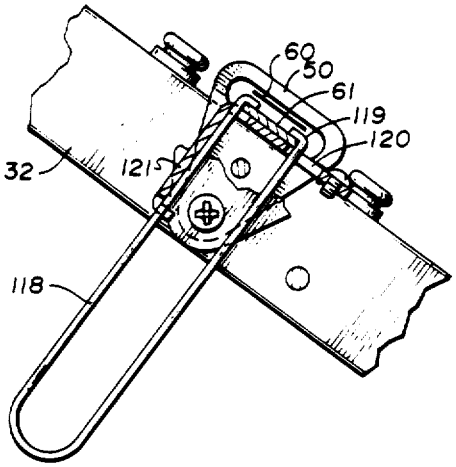
FIG. 11 is an elevated view, partially in section, showing the guide means for the tape.

The means for guiding and properly aligning the tape 61 during its movement past the printing station includes the guide wire 118 illustrated in FIGS. 9, 10 and 11. This guide wire includes a loop extending below the printing area and a pair of inwardly disposed ends 119 spaced above the tape guide bracket or chute 121. One side of the wire loop 18 is secured to a mounting bracket 122 which is in turn securely joined with the bracket 121. The other side of the wire loop 118 is designed for limited movement within the slot 120 to accomodate various sizes of tape 61 and to maintain such tape in proper alignment. In this respect, the right hand end 119 as viewed in FIG. 11 is a fixed member, whereas the left hand end 119 of FIG. 11 is a movable member which functions to continually bias the tape 61 into proper alignment. The spring strength of the wire loop 118 should be strong enough to maintain the tape 61 in proper alignment; however, it should not be so strong that it tends to curve or bend the tape 61.

Figure 6:
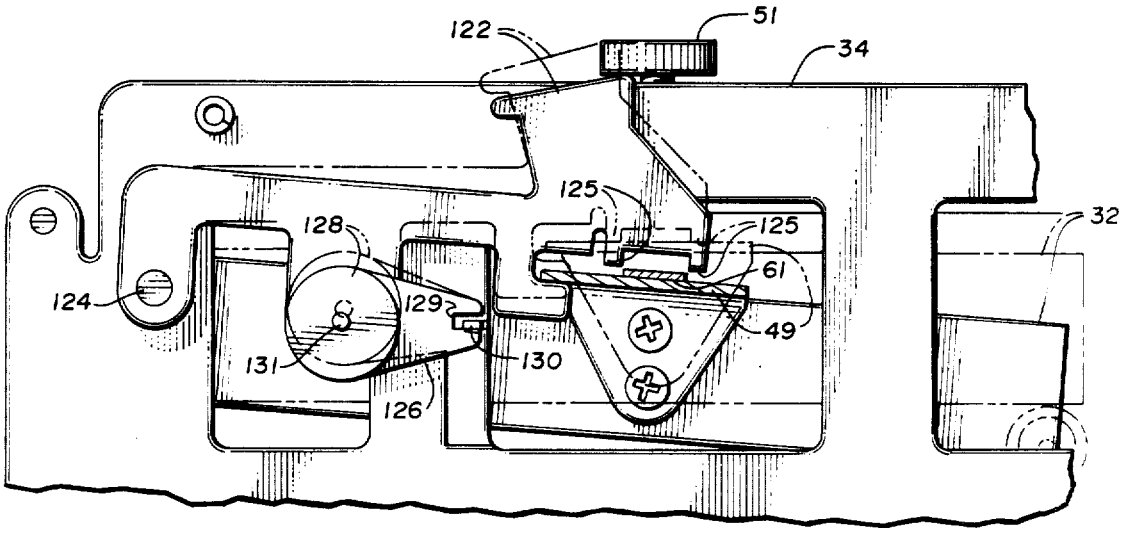
FIG. 6 is an elevated view showing the means for clamping the tape during a printing cycle.

The means for clamping or retaining the tape in engagement with the tape guide bracket 121 to prevent relative movement with respect to such bracket during the printing cycle includes the clamp member 122. This clamp member 122 is illustrated best in FIGS. 6, 9 and 10. As shown in FIG. 6, the clamping bracket is pivotable with respect to the apparatus frame about the pivot point 124 and includes a pair of clamping portions or tabs 125. The tabs 125 are spaced from each other a distance less than the width of the tape 61 and positioned with respect to the printing station such that they are adapted to engage opposite edges of the tape 61. In FIG. 6, the solid lines illustrate the relative position between the clamping tabs 125 and the tape when the printing bar 32 is in its lowermost position and the tabs are not engaged with the tape. The broken lines indicated the bar 32 in its upper position and the tabs 125 engaging the tape 61.

A friction clutch or brake member is pivotally connected with the clamping bracket 122 at the pivot 131 to restrain pivotal movement of the member 122. This friction brake includes an outer washer or retainer member 128 and a clutch arm 126 positioned between the washer 128 and the clamping bracket 122. As shown best in FIG. 10, a pair of friction members 132 are disposed between the clamping bracket 122 and the washer 128 on either side of the clutch arm 126 to resist relative rotational movement of the clutch arm 126 with respect to the clamping member. The forward end of the clutch arm 126 includes a recessed notch 129 for engagement with a stop member 130 securely joined with the apparatus frame. The function of the clutch or brake member is to insure sufficient clamping action between the clamping tabs 125 and the tape 61 and to insure that upon completion of the printing cycle, the clamping tabs 125 are spaced from the tape 61 to permit advancement thereof.

Upon initiation of the printing cycle, the lower print bar 32 begins to move upwardly bringing the tape 61 into engagement with the clamping tabs 125. When this occurs further upward movement of the print bar 32 and thus the clamp member 122 is resisted as a result of engagement between the clutch arm 126 and the stop member 130 and as a result of the frictional forces created by the friction disks 132 on either side of the clutch arm 126. Despite these resisting forces, the print bar 32 continues its upward movement with the clamping tabs 125 securely holding the tape 61 in a fixed position with respect to the print bar 32 and tape bracket 121. Accordingly, the clamping force of the tabs 125 on the tape 61 is directly proportional to the frictional forces generated between the friction disks 132 and clutch arm 126. As the lower print bar 32 reaches its highest position and begins its downward movement, the clamping bracket 122 will follow such movement for a limited distance until the upper surface of the notch 129 engages the stop member 130 at which time additional downward movement of the print bar 32 causes the clamping tabs 125 to separate from the tape 61. It should be noted that this tape clamping feature is coordinated with the tape and ribbon advance mechanism so that the tape and ribbon are advanced past the printing station after the clamping tabs 125 have been released.

As illustrated in FIG. 1 and 9, the clamping bracket 122 also serves as a ribbon rewind guide. As shown in FIG. 1, the ribbon, upon leaving the print station 11, passes under a portion of the clamping bracket 122 and between the clamping tabs 125. It then extends up and over a beveled edge portion of the clamping bracket 122 behind a generally vertical portion of the member 122 and then onto a ribbon rewind spool 134. The rewind spool 134 is mounted to a rewind shaft 135 journaled in a portion of the apparatus frame. The lower end of shaft 135 extends into a housing 136 which contains a one-way clutch member (not shown) permitting the spool 134 to turn only in the direction resulting in the ribbon 60 winding upon the spool 134. An appropriate apparatus is positioned below the housing 136 in the form of the link 138, the springs 139 and 140, the cord 141 and the bearing members 142 to exert a ribbon rewind force. One end of the cord 141 is connected to an end of the link 138 and extends around one of the bearings 142 after which it is wrapped one or more times around the lower end of the shaft 135 and then extends around the other bearing 142 after which it is connected to the spring member 139. The other end of the spring member 139 is in turn connected to the other end of the link 138. The second spring member has one end connected to a portion of the link 138 and the other end connected to a portion of the apparatus frame. The mechanism consisting of the elements 138–142 is effective to exert a rotational force on the shaft 135 tending to rotate it in a clockwise direction as viewed in FIG. 1 to wind the ribbon on the spool 134. It should be noted in the preferred embodiment that the spring 140 controls the magnitude of the force tending to rotate the shaft 135 in a clockwise direction, while the spring 139 controls the tension on the cord 141. In general, the ribbon rewind mechanism should generate a rewind force sufficient to pull the ribbon past the printing station when it is freely available, but not so strong that it pulls the ribbon from the ribbon-tape cartridge 62 when the ribbon is not fully available. It should also be noted that during each printing cycle, the lower arm 86 of the yoke member 78 contacts a portion of the link 138 and moves the link in a generally counterclockwise rotational direction as viewed in FIG. 1 so as to reset the rewind mechanism so that it is effective for continuously urging the shaft 135 in a rewind direction.

Figure 7:
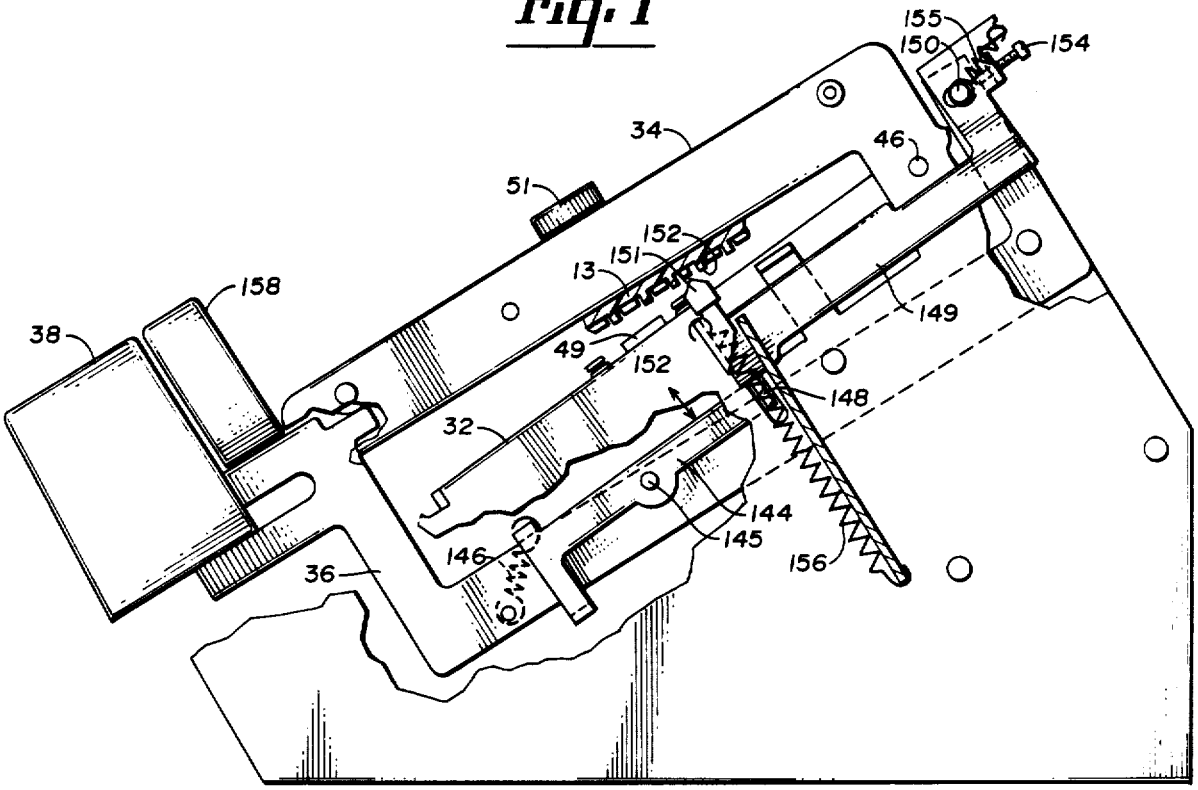
FIG. 7 is an elevated view showing the means for insuring alignment between the type disk or font element and the printing station.

A further feature of the present invention relates to the means for properly aligning the type disk or font 13 relative to the printing station. In this respect it should be noted that the type disk or font 13 is mounted on the post 116 in a free spinning manner. In other words, there are no detent or other means resisting its rotational movement of the font. As it is rotated to a particular character, it may or may not be exactly in alignment with the printing station so that the printing of the character aligns with the previously printed character. Accordingly, the structure of the present invention includes means for insuring proper alignment of the characters. This means is illustrated best in FIG. 7. As shown, this means includes a drive link 144 pivotally mounted with respect to the apparatus frame about the pivot point 145. One end of the link 144 is connected with the main actuating link 36 by a spring member 146. The other end of the link 144 includes a right angle portion 148 which is adapted for engagement with an alignment lever 149. As can be seen, when the print button 38 is depressed, the link 144 is rotated in a counterclockwise direction about the pivot 145 as a result of the spring member 146. This results in upward movement of the end 148 and corresponding upward movement of one end of the link 149. The link 149 is pivotally connected with the frame of the apparatus at the point 150 and includes an alignment member 151 consisting generally of a plastic member being beveled on two edges and terminated at a point. This alignment member 151 is adapted to be inserted between adjacent ribs or posts 152 positioned on the underside of the type disk or font 13. If the font is not properly aligned, the posts 152 would be engaged by one side or the other of the beveled alignment member 151 and upward movement of the member 151 would cause rotation of the font 13 into proper alignment. It should be noted that the link 149 is held in pivotal relationship about the point 150 by the spring member 155 and the threaded member 154. The link 149 may be returned by the extension spring 156 or by rotational motion of the font 13.

The apparatus also includes a means for cutting the tape 61 when printing of a particular designation has been completed. As shown best in FIG. 1, such means includes the cutting button 158, the linkage 159 and the cutting blade 160. Upon depression of the button 158, the linkage 159 functions in a known manner to move the blade 160 in cutting relationship with respect to the tape 61.

Having described the structure of the present apparatus, the operation thereof can be understood as follows. First, prior to the commencement of any printing cycle, a tape-ribbon cartridge 62 is inserted into the cartridge holder 65 (FIG. 5). This is done by lifting the cartridge holder cover 92 and inserting the cartridge therein. The tape and ribbon 61 and 60 are then fed past the printing station 11 and the ribbon 60 threaded around the clamping member 122 and connected with the rewind spool 134. The cover 92 is then closed and the printing cycle is ready to begin. Upon depression of the print button 38 the motor (in the electric version) is activated and the drive plate 14 is rotated in a clockwise direction. During initial rotational movement of the drive wheel 14, the link 19 (FIG. 3) rotates about the pivot 21 causing the link 28 to pivot about the pivot 29. This in turn causes rolling engagement between the roller 30 and the print bar 32 and results in upward movement of the print bar 32. At a given point during this upward movement, the clamping tabs 125 engage the upper surface of the tape 61 holding the same in a fixed position relative to the printing station. Following this clamping engagement, and still during clockwise movement of the drive link 19 and upward movement of the bar 32 the end 17 of the link engages the yoke arm 85 and moves the yoke 78 (FIG. 5) in a clockwise direction. This in turn causes corresponding rotational movement of the transfer plate 79 and the drive arm 80 in a clockwise direction. Such movement results in rearward movement of the cartridge carrier 65 as illustrated in FIG. 5. Such rearward movement continues until the stop member 96 engages the character spacing ring 98 at which point continued rotational movement of the yoke 78 and plate 79 results in extension of the override spring 89. During this rearward movement, the tape 61 and ribbon 60 are pulled from the cartridge 62 because of the ribbon rewind mechanism 134 and the tabs 125. As the drive link 19 reaches its upper most position, the print bar 32 also reaches its uppermost position exerting a printing pressure against the raised characters on the lower surface of the font 13. During this step, the printing pressure causes an image of the raised character to be transferred from the ribbon 60 to the image carrying tape 61.

As the drive link 19 begins to move downwardly, the print bar 32 also begins to move downwardly. Away from the upper print bar 34 and away from the raised character on the font. During initial downward movement of the print bar 32 the ribbon stripping element 50 engages the upper surface of the ribbon 60 pulling it away from the raised character in a generally perpendicular direction. Upon continued counterclockwise movement of the drive link 19 and downward movement of the member 32, the clamping tabs 125 (FIG. 6) are released from the tape. Upon still further downward movement of the print bar 32 and counterclockwise rotational movement of the drive link 19, the end 17 contacts the lower yoke arm 86 resulting in counterclockwise movement of the yoke 78 and corresponding counter-clockwise movement of the transfer plate 79 and drive arm 80 (FIG. 5). Such movement results in forward movement of the cartridge carrier 16 toward the printing station. Because the clamping means 125 has been released and because of the frictional forces within the elongated portion 64 of the cartridge 62, the tape 61 and ribbon 60 are advanced past the printing station in preparation for printing of the next character. Because of the stiffness of the tape 61 it merely continues through its alignment means 118 (FIG. 11) and out through the mounting chute or bracket 121 (FIG. 10). The ribbon is caused to rewind on the spool 134 (FIG. 1) as a result of the ribbon rewind mechanism, elements 138–142. The forward movement of the cartridge is limited by the relative position of the cam member 99. The apparatus is then in position for a subsequent printing cycle.

Although the description of the preferred embodiment of the present invention has been quite detailed and specific, it is contemplated that various changes and modifications could be made without deviating from the spirit of the present invention. Accordingly, it is intended that the scope of the present invention be dictated by the appended claims rather than by the description of the preferred embodiment.

We claim:

1. A dry lettering printing apparatus comprising:

a printing station;

means for providing a color carrying ribbon and an image carrying tape at said printing station;

means for advancing said ribbon and tape into printing alignment at said printing station;

means for providing a raised character into printing alignment at said printing station; and force generating means for exerting a printing force at said printing station to transfer an image of said raised character from said ribbon to said tape, said force generating means including an elongated print bar pivotally connected at one end to the frame of said printing apparatus and having a printing pad thereon defining said printing station, said force generating means further including a first toggle link pivotally connected between its ends to the frame of said printing apparatus at a first point, said first toggle link including a roller member rotatably mounted near one end of said link at a second point, said roller adapted to engage said print bar and move the same into printing engagement toward said raised character upon pivotal movement of said first toggle link about said first point, said force generating means further including a second toggle link being pivotally connected to the frame of said printing apparatus and a force transfer link extending between portions of said first and second toggle links.

2. A dry lettering printing apparatus comprising:

a printing station;

means for providing a color carrying ribbon and an image carrying tape at said printing station;

means for advancing said ribbon and tape into printing alignment at said printing station;

means for providing a raised character into printing alignment at said printing station;

force generating means for exerting a printing force at said printing station to transfer an image of said raised character from said ribbon to said tape, said force generating means including an elongated print bar pivotally connected at one end to the frame of said printing apparatus and having a printing pad thereon defining said printing station, said force generating means further including a toggle link pivotally connected between its ends to the frame of said printing apparatus at a first point, said toggle link including a roller member rotatably mounted near one end of said link at a second point, said roller adapted to engage said print bar and move the same into printing engagement toward said raised character upon pivotal movement of said toggle link about said first point; and means for applying a force to a third point on said toggle link to cause pivotal movement of said toggle link about said first point.

3. The printing apparatus of claim 2 wherein said roller engages said print bar near the other end of said print bar and said printing pad is positioned on said print bar between the ends of said print bar.

4. The printing apparatus of claim 3 wherein said printing pad is positioned on said print bar approximately midway between the ends of said print bar.

5. The printing apparatus of claim 4 including a force resisting means securely connected with the apparatus frame for resisting the printing force of said force generating means.

6. The printing apparatus of claim 5 wherein said force resisting means includes a printing force adjustment means comprising a force resisting foot portion and a means threadedly connecting said foot portion with said force resisting means.

7. The printing apparatus of claim 2 wherein the relationship between said print bar and said toggle link is such that the maximum printing force is generated as said toggle link approaches a position in which a straight line extending through said first and second points is generally perpendicular to the longitudinal axis of said elongated print bar.

8. The printing apparatus of claim 7 wherein the distance between said first and second points is approximately one third the distance between said second and third points.

9. The printing apparatus of claim 8 wherein said means for applying a force to said third point includes a force transfer link and an associated motor.

10. The printing apparatus of claim 8 wherein said means for applying a force to said third point includes a manually operable print button and a force transfer link extending between said print button and said third point.

11. A dry lettering printing apparatus comprising:

a printing station;

means for providing a color carrying ribbon and an image carrying tape at said printing station;

means for advancing said ribbon and tape into printing alignment at said printing station;

means for providing a raised character into printing alignment at said printing station;

force generating means for exerting a printing force at said printing station to transfer an image of said raised character from said ribbon to said tape, said force generating means including an elongated print bar pivotally connected at one end to the frame of said printing apparatus and having a printing pad thereon defining said printing station, said force generating means further including a toggle link pivotally connected between its ends to the frame of said printing apparatus at a first point, said toggle link including a roller member rotatably mounted near one end of said link at a second point, said roller adapted to engage said print bar and move the same into printing engagement toward said raised character upon pivotal movement of said toggle link about said first point; and a ribbon release means, said ribbon release means including an elongated ribbon release bar securely connected with and movable with said print bar and disposed along a line generally parallel to the longitudinal axis of, and spaced from, said print bar.

12. A dry lettering printing apparatus comprising:

a printing station;

means for providing a color carrying ribbon and an image carrying tape at said printing station;

means for advancing said ribbon and tape into printing alignment at said printing station;

means for providing a raised character into printing alignment at said printing station;

force generating means for exerting a printing force at said printing station to transfer an image of said raised character from said ribbon to said tape, said force generating means including an elongated print bar pivotally connected at one end to the frame of said printing apparatus and having a printing pad thereon defining said printing station, said force generating means further including a toggle link pivotally connected between its ends to the frame of said printing apparatus at a first point, said toggle link including a roller member rotatably mounted near one end of said link at a second point, said roller adapted to engage said print bar and move the same into printing engagement toward said raised character upon pivotal movement of said toggle link about said first point; and means for advancing said ribbon and tape includes a cartridge carrier for carrying a tape and ribbon supply cartridge, said cartridge carrier being movable reciprocally toward and away from said printing station.

13. The printing apparatus of claim 12 including a tape-ribbon cartridge containing a supply of ribbon and tape adapted for insertion into said cartridge carrier for movement therewith toward and away from said printing station.

14. The printing apparatus of claim 13 including gripping means for gripping said tape to prevent movement thereof relative to said printing station during movement of said cartridge carrier away from said printing station.

15. A dry lettering printing apparatus comprising:

a printing station;

means for providing a raised character into printing alignment at said printing station;

means for providing a color carrying ribbon and an image carrying tape at said printing station;

force generating means for exerting a printing force at said printing station to transfer an image of said raised character from said ribbon to said tape; and advancement means for advancing said ribbon and tape into printing alignment at said printing station, said advancement means including a cartridge carrier for carrying a tape and ribbon supply cartridge, said cartridge carrier being movable reciprocally toward and away from said printing station.

16. A dry lettering printing apparatus comprising:

a printing station;

means for providing a raised character into printing alignment at said printing station;

means for providing a color carrying ribbon and an image carrying tape at said printing station;

force generating means for exerting a printing force at said printing station to transfer an image of said raised character from said ribbon to said tape;

advancement means for advancing said ribbon and tape into printing alignment at said printing station, said advancement means including a cartridge carrier movable reciprocally toward and away from said printing station; and a tape-ribbon cartridge containing a supply of ribbon and tape adapted for insertion into said cartridge carrier for movement therewith forward and away from said printing station.

17. The printing apparatus of claim 16 including means for limiting the movement of said cartridge carrier away from said printing station and means for limiting the movement of said cartridge carrier toward said printing station.

18. The printing apparatus of claim 17 including means for preventing movement of said tape and ribbon relative to said printing station during rearward movement of said cartridge carrier.

19. The printing apparatus of claim 18 wherein said means for preventing movement of said tape includes a tape gripping means.

20. The printing apparatus of claim 19 wherein said tape gripping means includes a tape gripping bracket pivotally connected with the frame of said printing apparatus and a pair of gripping tabs for gripping opposite edge portions of said tape.

21. The printing apparatus of claim 20 wherein said means for preventing movement of said ribbon includes a ribbon rewind spool having a one-way clutch member.

22. The printing apparatus of claim 21 having means for releasing said tape gripping means during movement of said cartridge carrier toward said printing station.

23. The printing apparatus of claim 15 including linkage means operatively connected between said cartridge carrier and said force generating means for coordinating the exertion of said printing force and the movement of said cartridge carrier.

24. The printing apparatus of claim 23 having a free spinning rotatable font element including a plurality of raised characters about its peripheral edge for selective positioning into printing alignment at said printing station.

25. The printing apparatus of claim 24 including means for insuring proper alignment of said font element and proper printing alignment of said raised character.

26. The printing apparatus of claim 25 wherein said alignment means includes an alignment tab having a pair of beveled surfaces movable into engagement with corresponding alignment ribs on said font element.

27. The printing apparatus of claim 16 wherein said cartridge includes means for guiding said tape and ribbon toward said printing station.

28. The printing apparatus of claim 15 having means for guiding said tape and ribbon into printing alignment with respect to said printing station.

29. A dry lettering printing apparatus comprising:

a printing station;

means for providing a raised character into printing alignment at said printing station;

means for providing a color carrying ribbon and an image carrying tape at said printing station;

force generating means for exerting a printing force at said printing station to transfer an image of said raised character from said ribbon to said tape;

advancement means for advancing said ribbon and tape into printing alignment at said printing station, said advancement means including a cartridge carrier movable reciprocally toward and away from said printing station; and means for guiding said tape and ribbon into printing alignment with respect to said printing station including a wire loop having a generally U-shaped configuration with one leg in a fixed position relative to said print bar and the other leg adapted for limited movement to accommodate various widths of tape and to continuously bias said tape toward said fixed leg.

* * * * *